United States Patent [19]

Ohashi

[11] B 3,996,441

[45] Dec. 7, 1976

[54] SWITCH WITH ROCKER ACTUATOR HAVING DETACHABLE COVER

[76] Inventor: Shigeo Ohashi, c/o Nihon Kaiheiki Kogyo Kabushiki Kaisha, 5-14 Minamimagome 1-chome, Oto, Tokyo, Japan

[22] Filed: May 17, 1974

[21] Appl. No.: 470,899

[44] Published under the second Trial Voluntary Protest Program on March 2, 1976 as document No. B 470,899.

[30] Foreign Application Priority Data

July 9, 1973 Japan ..... 48-80524[U]

[52] U.S. Cl. ..... 200/309; 200/315

[51] Int. Cl.[2] ..... H01H 9/18

[58] Field of Search ..... 200/309, 339, 315, 314; 116/124 L

[56] References Cited

UNITED STATES PATENTS

| | | | |
|---|---|---|---|
| 3,154,661 | 10/1964 | Bierenfeld | 200/309 |
| 3,160,731 | 12/1964 | Gemmell | 200/309 |
| 3,435,169 | 3/1969 | Bienwald | 200/315 |
| 3,598,950 | 8/1971 | Ohashi | 200/315 |
| 3,601,566 | 8/1971 | Hansen et al. | 200/314 |

*Primary Examiner*—Robert K. Schaefer
*Assistant Examiner*—William J. Smith
*Attorney, Agent, or Firm*—Lawrence I. Field

[57] ABSTRACT

A miniature switch with a removable cap on the actuator, so that any cap may be replaced with another of different appearance.

1 Claim, 8 Drawing Figures

SWITCH WITH ROCKER ACTUATOR HAVING DETACHABLE COVER

The present invention relates to a miniature switch, and more particularly it relates to a miniature switch to which an actuator or an operation button is detachably fixed.

In recent years the design of machinery has tended to be concerned primarily with improvement of the inner mechanism of machinery itself. Therefore in the switch which is used in such machinery there has come to be attached great importance not only to the inner mechanism but also to the exposed part and many other things such as a choice of form and color to match the design of machinery; moreover a choice of form and color of switch operation part according to the character of machinery have come to be required. Accordingly switch makers have come to be required to supply immediately switch mechanism of any form and color that machinery users require.

An illuminated type miniature wave-shaped switch in which an operation button formed with a converter as one body is manipulated right and left to actuate a movable contact plate and to take the switch contacts on and off and also in which an opening into which a transparent illuminating plate is snugly fitted is formed at the central part of the operation button has been invented by the inventor of the present invention. This wave-shaped switch is described in detail in specification of 1969 Japanese Utility model registration application No. 97049. However, since the wave-shaped switch described in the above specification has the construction wherein a somewhat curved transparent illuminating plate is merely fitted into the opening formed at the upper central part of the operation button, when the transparent illuminating plate is smaller in size than the opening the switch is easily inserted and also easy to take out and when the transparent illuminating plate is somewhat bigger than the opening the switch is hard to insert and once it is installed it is hard to remove. Moreover, since the operation button is formed with the converter as one body, when these two are separated there is a disadvantage that to take out the lamp installed inside the switch must be overhauled and the operation button must be separated from the switch body. Therefore the initial purpose has not been attained and the above invention has not been utilized.

The present invention has been devised to eliminate the defects and inconveniences such as mentioned above, and it is therefore an object of the present invention to provide a new illuminated type miniature switch in which the operation button is detachably fixed to the converter, and the confronting inside plane at the lower part in operating direction of operation button is an inclined plane detached each other in proportion as going downward, and an inclined surface, a projection or a widened part formed under the cover elastically touches the aforesaid inclined plane, therefore the cover can be easily assembled to the upper part of the operation button and also after being installed the two are firmly attached, when the two are separated the cover can be easily separated from the operation button only if the operation button is separated from the converter.

It is another object of the present invention to provide a new miniature switch in which the color of the cover fitted into the operation button is different from that of the button frame of the operation button, and the switch cover is classified by color according to the purpose of switch based on the kind of machinery, therefore it is easy to operate the switch and the occurrence of accidents can be prevented.

The features of the present invention will become apparent from reading the following detailed description of the present invention in conjunction with the accompanying drawings, in which.

Figure 1:
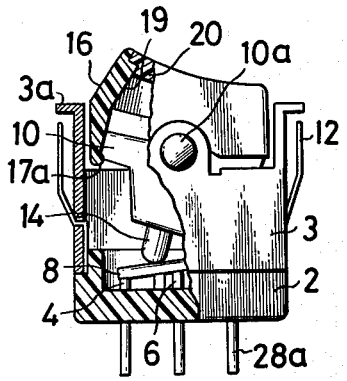
FIG. 1 is a part of sectional view partly in section showing an embodiment of the switch according to the present invention.

The reference numeral 2 designates a known base formed of insulating material and at the upper part of said base 2 the side body 3 is fixed and these two form a casing for the switch according to the present invention. Said casing includes contacts 4 secured in the inner bottom face, movable contact receivers 6 secured in the inner bottom face, movable contacts 8 which can move in a rocking motion according to the rocking motion of the operation button or the actuator on said receivers 6, a converter 10 which transmits the rocking motion from the operation button to said movable contacts 8, and other materials incidental to actuation. Flanges **3*a* are formed at the upper part of side body 3, and a switch fixing plate 12 formed of an elastic material which is used when a switch is fixed to a panel is installed at right and left sides adjacent to the flanges 3*a* of side body 3. In the drawings showing embodiments plug-in-type flanges 3*a* are used, but it is apparent that screw-type flanges can be used. An axis 10*a* extends through the converter 10, and by the shaft the converter 10 is connected to the side body 3, so as to swing freely. At the lower part of converter 10 a hole (which is not shown in the drawing) is cut, and in said hole a slider 14 is fitted which is to slide on the movable contacts 8** through a spring (not shown in the drawing).

Figure 3:
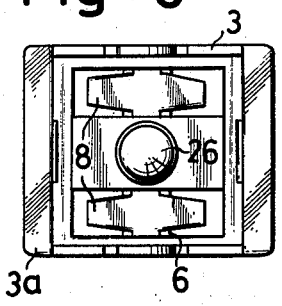
FIG. 3 is a bottom plan view of the switch according to the present invention.
Figure 4:
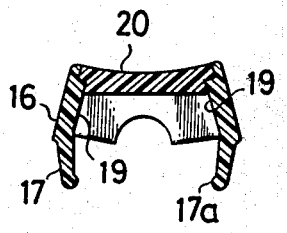
FIG. 4 is a sectional view showing the button frame and the cover of the operation button of the switch according to the present invention.
Figure 5:
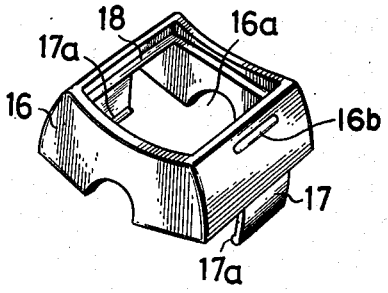
FIG. 5 is a perspective view showing an embodiment of the button frame used in the switch according to the present invention.
Figure 6:
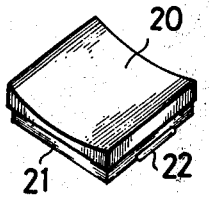
FIG. 6 is a perspective view showing an embodiment of the cover used in the switch according to the present invention.
Figure 7A:
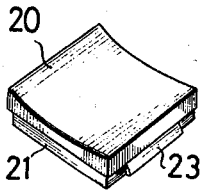
FIGS. 7A and 7B are respectively a perspective view and a side view showing another embodiment of the cover.
Figure 7B:
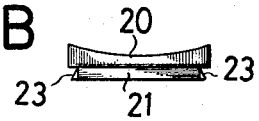

At the upper part of the converter 10 an actuator frame or an operation button frame 16 is provided. Frame 16 which is formed of synthetic resin material or the like having some elasticity, is detachably fixed by attaching a projection **17*a* of the tongue 17 at the lower side wall of the converter 10. At the central part of the operation button frame 16 an opening 16*a* is provided to fit a cover which will be described later and a slot 16*b* (refer to FIG. 5) to hang a hook is cut at the confronting outside in the actuating direction of operation button. At the side where a slot 16*b* is cut a tongue in which a projection 17*a* is fixed, extended downward and engaged to the lower side wall of the converter 10. As shown in FIG. 3 and FIG. 4 around the opening 16*a*** at the upper inside of button frame 16 a step part 18 is formed, and the lower confronting inside followed by the step part 18 is formed at the inclined plane 19 which is detached each other in proportion as going downward. Into the opening 16*a* of the button frame 16 a cover 20 is detachably fixed. The cover 20 consists of the upper and the lower parts, the lower part is formed a little smaller than the upper part and also the lower part has an undercut 21 into which the corresponding portion of the inclined plane 19 of button frame 16 extends. FIG. 6 and FIGS. 7A, 7B show two embodiments of a cover of the switch according to the present invention. FIG. 6 is an embodiment in which a projection 22 is provided at the position corresponding to the inclined plane 19 of button frame of the undercut 21, and FIGS. 7A, 7B shows an embodiment in which the portion connecting to the inclined plane 19 is another inclined plane 23 cover 20 and frame 16 can be detached from each other. What is important is that the length of a projection 22 or an inclined plane 23 should be necessarily shorter than the length of the side in which said projection or an inclined plane is formed so that it is easy to fit snugly into the frame. The structure of the portion corresponding to the inclined plane 19 of portion 21 of the cover is not so limited since the inclined plane 23 can be a bent inclined plane, also that a projection or an inclined plane 23 can be divided into more than two parts, indeed any kind of form or structure can be used provided the portion 21 of the cover 20 is elastically engaged and closely fitted to the inclined plane 19 of button frame.

Figure 2:
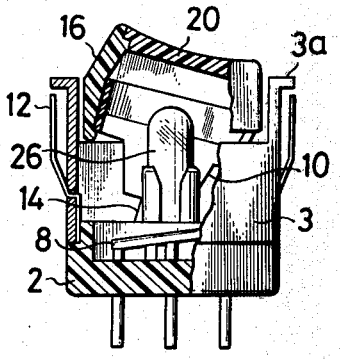
FIG. 2 is a similar view showing one arrangement of a radiation element at the inside of switch according to the present invention.

The inside of the base 2 is divided into three parts as shown in FIG. 3 and the two sides of it are two contacts divisions each having a movable contact 8, and the central part is, for example, a section to accommodate a radiation element 26 such as indication lamp, neon bulb, radiation diode or the like. In each contact division a movable contact receiver 6 is secured at the central part, on which a movable contact 8 is positioned so that it moves right and left freely. In the central division, radiation element 26 is mounted at centrally and the upper part extends upward through each central empty part of slider 14 and button frame 16 as to illuminate the cover 20 from the bottom (refer to FIG. 2).

When the cover 20 of switch according to the present invention is to be snugly fitted to an opening 16*a* of the operation button frame 16, the cover 20 is inserted into the opening 16*a* and said cover is pushed from outside by a finger or said cover is lightly pushed by a finger so that the cover 20 and the frame 16 touch each other. In this manner one side of the upper part of the cover 20 is fitted into one side of the step part 18 of the button frame 16, moreover a projection 22 of the step part at the cover or the extreme point of one side of the inclined plane 23 is touching one side of the inclined plane 19 of the button frame. Since these two are formed of synthetic resin material or the like having a little elasticity and the inclined plane 19 is formed to be detachably connected to each other in proportion as going downward, by the power added to the upper part of the cover 20 a projection 22 of the other side of said cover or the extreme point of the inclined plane 23 presses the inside wall of the other side of corresponding button frame. Therefore said inside wall (namely, the other side of step part 18 and the following inclined plane 19 of the other side) is extended outside, in consequence, a projection 22 of the other side or the inclined plane 23 is moved from the other side of step part 18 to that of the inclined plane 19 and is engaged and attached to that of the inclined plane 19. At the same time the other upper side of the cover 20 is fitted into the other side of step part 18 of button frame and said inside wall returns to where it was and makes a click sound. Therefore these two, namely the extreme point of a projection 22 or an inclined plane 23 is elastically fixed to the inclined plane 19 as if fitted into the caved place and they do not come off even if there is some vibration or there comes outside power added. Moreover in order to fit a button frame 16 into a converter 10, they are lightly pressed in actuation or operation direction and a projection 17*a* of operation button is engaged to the shoulder of a converter and is elastically fixed.

To take button frame 20 off from the converter 10, one slot 16*b* of button frame is put on by a thumb nail and turned upward to separate them being the other slot as a central axis. On this occasion a projection 17*a* of the side where a nail is put on is taken off from engagement with the lower side wall of a converter 10 and they are separated and radiation element installed inside can be exchanged. In order to take the cover 20 off from button frame 16, operation button, namely actuator is taken on hand and inside of the cover 20 is pressed by a thumb or other finger. On this occasion every part is actuated in the opposite way to above said occasion and returns back after said inside wall is extended outside similarly and then a projection 22 of a cover or the extreme point of an inclined plane 23 is taken off from close contact with an inclined plane 19 of button frame and they are easily separated. What is important is is that in order to separate a cover 20 from operation button frame 16 the button frame 16 must be separated from a converter 10 first, otherwise it cannot be easily separated, and this point is also one characteristic according to the present invention. Therefore according to the present invention operated as mentioned above, a cover can be easily fitted into the upper part of operation button or an actuator. Once they remain fitted, they are securely attached without separating from each other even if there is some vibration or outside power and when they are separated the cover can be easily separated from operation button only if the button frame is separated from the converter.

Since the switch according to the present invention has above said effects and characteristics, the color of the cover fitted into operation button can be different from that of the button frame of operation button. Therefore according to the on and off purpose of switch based on the character of machinery, the color of switch cover can be provided for each purpose, for example, blue switch for normal turning, red switch for opposite turning, white switch for lamp, orange switch for fan. By this color provision switch can be easily operated and an outbreak of the accident can be prevented. These are the advantages of the present invention.

Since the switch according to the present invention is detachably fixed as mentioned above to enable to be easily separated the cover 20 of the upper part of switch from button frame 16, when said button frame 16 of an actuator is limited one color (one kind) the cover can be immediately changed as the needs of the case demand if only the covers of red, blue and many kinds are kept in stock. This is also an advantage to enable to decrease the stock.

In the switch according to the present invention the cover 20 and the button frame 16 are detachably fixed therefore the color of the covers can easily be different from that of the button frame and the button can be colorful, graceful and beautiful.

The conventional switch actuators known as this type are mostly complicated in form, therefore when some carving on the surface is made, for example, letters or marks corresponding to the on and off of the switch, a special utensil to fix it must be prepared and then the carving must be made. Otherwise the actuator is moved a little or slipped out, and because of a cutting tool to carve, in case of letters they become vibrating letters. They are awkward and this point is a fault of the traditional switches. However in the switch according to the present invention an actuator or a cover 20 which is a surface of operation button can be taken off from the button frame 16, moreover since the surface of the cover 20 is simply plain, when some carving is made on the surface, what the carving is made on namely the cover 20 can be easily fixed to the cutting tool to carve. Therefore according to the present invention without using the special utensil the carving can be made on the surface of the actuator as desired.

When the switch according to the present invention is used, for example, as an illuminated type switch in which there is radiation element such as a lamp, a neon ball, radiation diode or the like a transparent cover can be chosen according to the illumination of the radiation element.

In the switch according to the present invention shaping efficiency is considered. To take a part of button frame 16 off from shaping metal mold easily, an inclined plane 19 which is detached each other in proportion as going downward is fixed in the confronting inside of said button frame. Therefore without having the special caved place to fit, the inclined plane 19 is just made use for the caved place to fit, so that the cover is very well fitted into the button frame and it has a very rational form. Therefore the metal mold is not complicated such as split mold and so it is cheap and can be mass-produced in high efficiency. For example in case the special caved place to fit the cover is shaped at the upper part of button frame, since what is shaped can not be pulled out from the metal mold because of the caved place, shaping metal mold in this case must be complicated such as split mold. Therefore the shaping efficiency of the metal mold in this case is less than 30% of the case when the metal mold of the button frame of the switch according to the present invention is used.

Since the cover 20 is detachably fixed from the button frame 16, not only the cover can have the various colors but the various formed covers can be used if it is necessary and by that quite different operation part can be formed.

Since the cover 20 in the switch according to the present invention is constructed shown in the accompanying drawings, it is not necessary to have special tongues, therefore the whole cover can be a plain form. Accordingly as mentioned above, letters and marks can be easily carved on the surface and also in case when an illuminated type switch is used in which there is radiation element such as a lamp, thickness of the cover is equal without becoming extremely big in some part as a tongue is not fixed at the cover. Therefore there is an advantage that illumination from radiation element to the cover is equalized.

While the invention has been described centering on the embodiments shown in the accompanying drawings, it will be understood that these embodiments are merely illustrative and not restrictive to the scope of the present invention. That is, the present invention can be embodied in many other forms with various changes and modifications without departing from the spirit and the scope of the invention and all of these changes and modifications are embraced within the scope of the claims that follow.

What is claimed is:

1. In an illuminated miniature switch including a base formed of an insulating material, a casing consisting of side-walls extending upwardly from and fixed to the upper part of said base, lamp means within said casing, and a convertor member pivotally supported in said casing and having a rocking motion, corresponding to the rocking motion of a cup shaped operating button, said operating button being formed of a synthetic resin material, possessing some elasticity and including means at one end for detachably attaching one end of said operating button to said pivotally supported convertor the improvement which comprises:

providing an opening in the upper face of said operating button, said opening being defined by a peripheral ledge extending around the periphery of said opening from inwardly inclined walls defining a lower portion of said opening and at least one recess in the lower portion of at least one of said walls; and providing a cover adapted to be detachably received in said opening and supported on said walls said cover including a projection extending outwardly from said cover and in a direction generally in a plane parallel to the plane of the cover and adapted to be received in the recess in said inclined sidewall of said operating button and to secure said detachable cover in said opening.

* * * * *